US007396439B2

(12) United States Patent
Sasaki et al.

(10) Patent No.: US 7,396,439 B2
(45) Date of Patent: Jul. 8, 2008

(54) METHOD AND APPARATUS FOR AN ANODIC TREATMENT

(75) Inventors: Masato Sasaki, Kanagawa-ken (JP); Yuzuru Morioka, Kanagawa-ken (JP); Sachiko Sugita, Kanagawa-ken (JP); Masazumi Ishikawa, Kanagawa-ken (JP)

(73) Assignee: Hitachi, Ltd., Tokyo (JP)

( * ) Notice: Subject to any disclaimer, the term of this patent is extended or adjusted under 35 U.S.C. 154(b) by 624 days.

(21) Appl. No.: 10/860,150

(22) Filed: Jun. 4, 2004

(65) Prior Publication Data

US 2004/0216996 A1 Nov. 4, 2004

Related U.S. Application Data

(62) Division of application No. 10/045,014, filed on Jan. 15, 2002, now Pat. No. 6,821,408.

(30) Foreign Application Priority Data

Jan. 15, 2001 (JP) ..... 2001-006525
Aug. 6, 2001 (JP) ..... 2001-238157

(51) Int. Cl.
*C25D 17/06* (2006.01)
*C25D 11/04* (2006.01)

(52) U.S. Cl. ..... 204/272; 204/242; 205/133; 205/324

(58) Field of Classification Search ..... 204/224 R, 204/324–333; 205/118, 148
See application file for complete search history.

(56) References Cited

U.S. PATENT DOCUMENTS 3,964,278 A * 6/1976 Korsch et al. ..... 68/5 E
4,024,047 A * 5/1977 Clark et al. ..... 204/671
4,029,564 A * 6/1977 Higuchi et al. ..... 204/224 R
5,215,636 A * 6/1993 Danilychev et al. ..... 204/164
5,660,699 A 8/1997 Saito et al.
5,750,014 A * 5/1998 Stadler et al. ..... 204/224 R
5,843,296 A 12/1998 Greenspan
6,126,808 A 10/2000 Rasmussen (Continued)

FOREIGN PATENT DOCUMENTS

DE 43 26 430 A1 2/1995

(Continued)

OTHER PUBLICATIONS

"Apparatus for Anodizing a Cylindrical Aluminum Coating on a Copper Piston", IBM Technical Disclosure Bulletin, IBM Corp., vol. 33, No. 6A, Nov. 1990, pp. 318-319.

(Continued)

*Primary Examiner*—Harry D Wilkins, III
(74) *Attorney, Agent, or Firm*—Foley & Lardner LLP

(57) ABSTRACT

A method and apparatus for anodizing a component. The component is placed in a container having first and second seal members that seal an annular surface of the component to be anodized. The first and second seal members, the annular surface of the component, and an inner surface of the container form a reaction chamber that holds a reaction medium therein. The reaction medium is supplied to the reaction chamber through a supply passage formed in the container. The reaction medium is drained from the reaction chamber through a drain passage formed in the container.

14 Claims, 17 Drawing Sheets

U.S. PATENT DOCUMENTS

2002/0100695 A1* 8/2002 Sasaki et al. ..... 205/333

FOREIGN PATENT DOCUMENTS

FR 2 574 095 A1 6/1986
JP 58-167777 A 10/1983
JP 4-224695 A 8/1992
JP 9-217200 A 8/1997

OTHER PUBLICATIONS

Buran et al., "Properties of Plasma Spray Coatings for Piston Ring Running Surfaces", Plasma Techniques Symposium, vol. 2, pp. 25-36.

* cited by examiner

METHOD AND APPARATUS FOR AN ANODIC TREATMENT

The present application is a divisional of U.S. application Ser. No. 10/045,014, filed Jan. 15, 2002, now U.S. Pat. No. 6,821,408, the entire contents of which are incorporated herein by reference.

BACKGROUND OF THE INVENTION

1. Field of the Invention

This invention relates to a method and an apparatus for an anodic treatment on a surface of a piston used for an internal combustion engine. More particularly, the present invention relates to a method and an apparatus for anodizing an annular surface of the piston.

2. Description of the Related Art

It is well known that a portion of the piston used in the internal combustion engine is placed close to a combustion zone. More particularly the portion of the piston is in contact with relatively hot gases, and therefore, is subject to high-thermal stresses that may cause deformations or changes in the metallurgical structure. This negatively affects functions of the portion.

As a measure against such negative affections, a surface of the piston has been treated by an anodic treatment in order to develop an anodic oxide coating that protects a metal of the piston from undesirable affections of heat. One such apparatus that performs the anodic treatment is disclosed in, for example, a Japan Patent Publication (koukai) No. 9-217200 (incorporated herein by reference). According to the publication, as shown in FIG. 19, the apparatus includes a jacket 101, a lid member 102, a mask socket 103, an O-ring 105, an electrolyte bath 106, a nozzle system 107, a cathode 108, and an anode 109. The jacket bath 101 forms a part of a circulation circuit of electrolyte (reaction medium), and is substantially like a cup shape. The jacket 101 has an opening, which is closed by the lid member 102, at its upper end. A hole in which the mask socket 103 is fitted is formed at the center of the lid member 102. The mask socket 103 is substantially cylindrical in shape, and is provided its lower opening portion with an inwardly projected flange portion. A piston 104 is inversely placed in the mask socket 103. Namely, the piston 104 is inserted into the mask socket 103 from its head portion (piston head).

The O-ring 105 is placed on the flange portion. The O-ring 105 touches a surface of the piston head when the piston 104 is placed in the mask socket 103. Thereby, a portion of the piston not to be anodized is sealed. The nozzle system 107, through which the electrolyte is directed to the piston 104, is placed in the electrolyte bath 106 that is provided in the jacket 101. The cathode 108 is provided at an upper portion of the electrolyte bath 106. The anode 109 is in contact with the piston 104. The apparatus disclosed in the publication thus performs the anodic treatment on an end face of component (piston) that is cylindrical or columnar in shape.

According to the publication, however, since the O-ring 105 touches the surface of the piston head, there is a difficulty in anodizing a limited area defined at a middle portion on a cylindrical surface. That is, for instance, where the anodic treatment on the end face of the component (piston) is unnecessary while the anodic treatment on the limited area at the middle portion on the cylindrical surface is carried out, a masking of a portion of the component (the end face) is required to prevent the end face from being anodized. However, to make a mask portion, a masking process to the end face of the component must be accomplished before putting the component in the apparatus. This causes a decline of working efficiency and processing ability.

The electrolyte upwardly flows to the end face of the component through the nozzle system 107, and then, downwardly moves away from the end face to be drained from the electrolyte bath 106. The electrolyte supplied to the end face meets the electrolyte leaving from the surface, which causes an obstruction to a smooth circulation of the electrolyte. To provide the smooth circulation, a large area for flow of the electrolyte is necessary, and thereby, the size of the apparatus becomes large.

SUMMARY OF THE INVENTION

According to an embodiment of the present invention a method for anodizing a component is provided. The method includes placing the component in a container having first and second seal members and sealing an annular surface of the component to be anodized using the first and second seal members to thereby form a reaction chamber bounded by the annular surface, the seal members and an inner surface of the container. The method further includes supplying a reaction medium to the reaction chamber through a supply passage formed in the container to thereby anodize the annular cylindrical surface.

In another embodiment, the method may further include the step of removing the reaction medium from the reaction chamber through a drain passage formed in the container. The steps of removing and supplying may be conducted simultaneously to thereby circulate the reaction medium through the reaction chamber.

According to an alternative embodiment of the present invention, an apparatus for anodizing a component is provided. The apparatus includes a container having a receiving hole for receiving the component into the container. The apparatus further includes first and second seal members for sealing an annular surface of the component to thereby form a reaction chamber between the container and the annular surface of the component.

The apparatus may further include a supply passage in the container for introducing a reaction medium into the reaction chamber and a drain passage for draining the reaction medium from the reaction chamber. The apparatus may also include a first electrode for energizing the component and a second electrode for energizing the container adjacent to the reaction chamber. Preferably, the container includes a passage plate having an opening for the component to extend through, wherein the passage plate includes a supply groove and a drain groove opening into the reaction chamber.

It is to be understood that both the foregoing general description and the following detailed description are exemplary and explanatory only, and are not restrictive of the invention as claimed.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

FIG. 3(*b*) is an enlarged sectional view of an alternative embodiment of the passage plate taken on line A-A of FIG. 2.

DETAILED DESCRIPTION

Accordingly, in view of above-described problems encountered in the conventional art, one object of the present invention is to provide a method and an apparatus for anodizing a component at a limited portion on its cylindrical surface made at a middle portion without requiring a masking procedure.

According to an embodiment of the present invention a method for an anodic treatment that comprises the operations of putting a component in a container is provided. The container is provided therein with a first and a second seal members. The method includes sealing a boundary between a portion being treated and another portion on a surface of the component by the first and second seal members for defining an annular cylindrical surface at a middle portion on the surface of the component. The first and second seal members, the annular cylindrical surface and an inner surface of the container form a reaction chamber that holds a reaction medium therein. The method further includes supplying the reaction medium to the reaction chamber through a supply passage formed in the container, and draining the reaction chamber from the reaction medium through a drain passage formed in the container.

According to another embodiment of the present invention, an apparatus for an anodic treatment includes a container that includes a receiving hole and a bottom portion. The container receives a component in the receiving hole thereof, and defines up and down directions and a horizontal direction. A first and a second seal members that is disposed in the receiving hole for sealing a boundary between a portion being treated and another portion on a surface of the component. The first and second seal members define an annular cylindrical surface at a middle portion on the surface of the component. A reaction chamber that is formed among the annular cylindrical surface, an inner surface of the container, and the first and second seal members. The reaction chamber holds a reaction medium therein. An inlet passage is formed in the container for introducing the reaction medium into the reaction chamber, an outlet passage formed in the container for draining the reaction chamber from the reaction chamber. The apparatus further includes a first electrode for conducting an electricity to the component, and a second electrode for conducting the electricity to the reaction medium.

Figure 1:
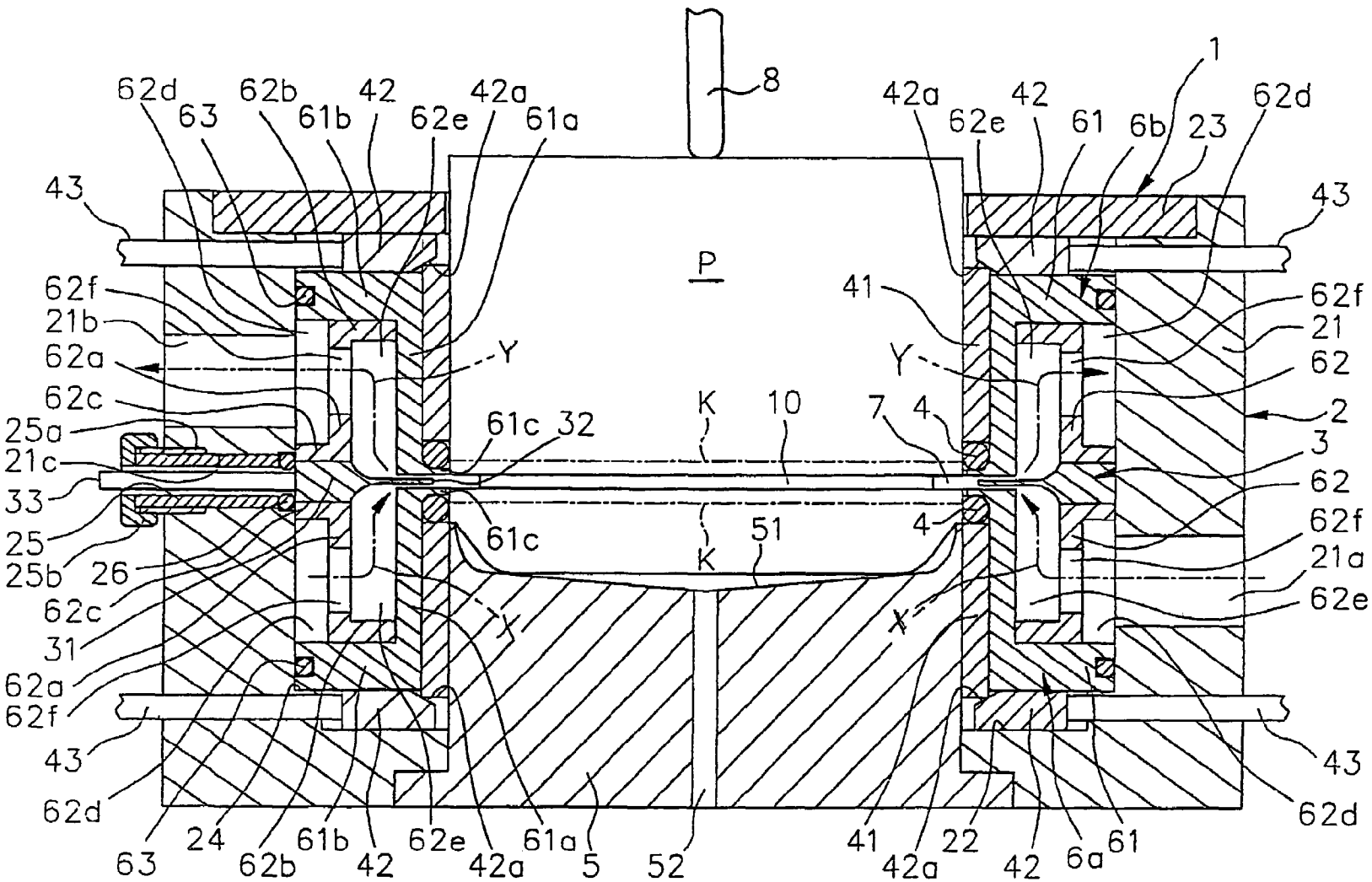
FIG. 1 is a sectional view of an anodizing apparatus according to a first embodiment of the present invention.
Figure 2:
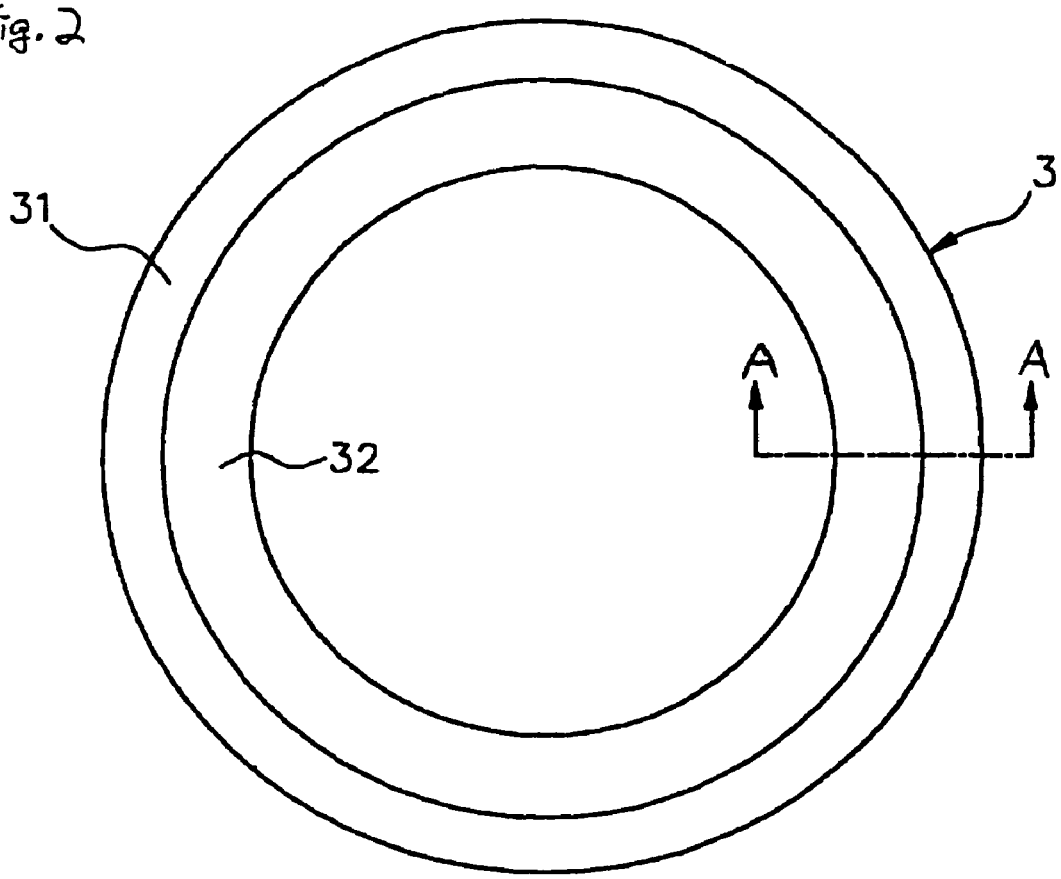
FIG. 2 is a front view of a passage plate according to the first embodiment of the present invention.
Figure 3:
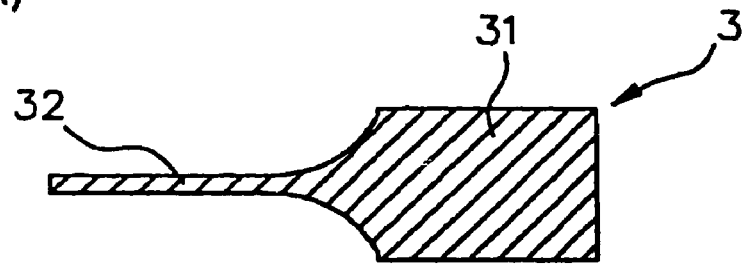
FIG. 3(*a*) is an enlarged sectional view of the passage plate taken on line A-A of FIG. 2.
Figure 3B:
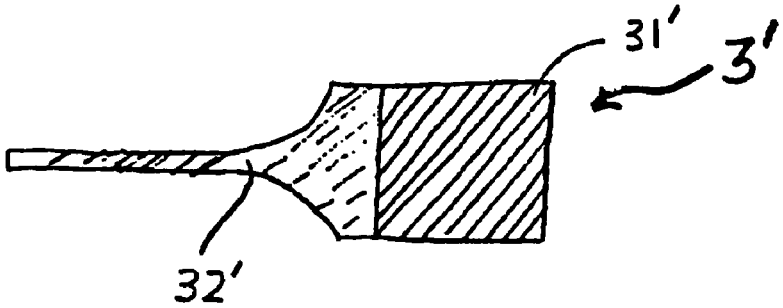

An apparatus for an anodic treatment according to preferred embodiments will now be described with a reference to the drawings. FIGS. 1-3 show a first embodiment of the present invention. According to the first embodiment of the present invention, the apparatus provides an anodic oxide coating on a surface of a top-ring groove of a piston P. As shown in FIG. 1, the apparatus comprises a container 1, an outer cylindrical member 2, a passage plate 3, a first and a second seal members (O-ring) 4, 4, and a push mechanism. The push mechanism comprises a first and a second sleeves 41, 41, a first and a second push rings 42, 42, and plural push rods 43. The container 1 may be cylindrical in shape, and includes a receiving hole (not numbered) for receiving the piston P with an inverted (upside-down) state, a bottom member 5, and a lower and an upper wall members 6*a*, 6*b*. The outer cylindrical member 2 includes a cylindrical wall section 21 and an inwardly projected flange section 22. An upper end of the cylindrical wall section 21 is closed by an annular cover member 23. The annular cover member 23 and the flange section 22 project inward, respectively, from the upper and a lower end of the outer cylindrical member 2, thus defining an annular groove that receives the lower and upper wall members 6*a*, 6*b*. The bottom member 5 forms a bottom portion of the container 1, and is substantially cylindrical in shape having an outer diameter approximately equal to an outer diameter of the piston P. The bottom member 5 is arranged in the outer cylindrical member 2, with its lower periphery being fitted in the flange section 22, to form the container 1.

While the shape of various components mentioned herein is described as cylindrical, this shape is merely preferred. The present invention includes within its scope a container, component and other mentioned elements having various shapes suitable for use with the apparatus and method described herein.

The lower and upper wall members 6*a*, 6*b* each comprise an exterior member and an interior member. That is, the lower wall member 6*a* includes an exterior member 61 and an interior member 62, and similarly, the upper wall member 6*b* comprises an exterior member 61 and an interior member 62. Each of the exterior members 61, 61 included in the lower and upper wall members 6*a*, 6*b* has a cylindrical section 61*a*, an outward flange section 61*b*, and an inward flange section 61*c*. More particularly, in an assembled state as shown in FIG. 1, the outward flange section 61*b* is formed at a lower portion of the cylindrical section 61*a* of the lower wall member 6*a*, while the inward flange section 61*c* is provided at an upper portion. The inward flange section 61*c* of the exterior member 61 included in the lower wall member 6*a* positions and supports the first O-ring 4. The exterior member 61 is arranged in the annular groove of the outer cylindrical member 2 having an end face of the outward flange section 61*b* in an abutted contact with a stepped portion 24 formed on the flange section 22.

The first sleeve 41 is disposed between the exterior member 61 of the lower wall member 6*a* and the bottom member 5, with a slidable contact in an axial direction of the outer cylindrical member 2, to push the first O-ring 4. The first push ring 42 is arranged between the flange section 22 and the outward flange section 61*b* of the exterior member 61 included in the lower wall member 6*a* with a slidable contact in a radial direction of the outer cylindrical member 2. The first push ring 42 is provided thereon with a tapered surface 42 that is in contact with a lower end portion of the first sleeve 41. Also, the first push ring 42 is arranged in a space defined between an upper surface of the flange section 22 and the end face of the outward flange section 61*b* of the lower wall member 6*a*. The push rods 43 are slidably received in holes radially formed in the cylindrical wall section 21, and are arranged to push the push ring 42 in an inward direction thereof.

The interior member 62 included in the lower wall member 6*a* comprises, in the assembled state, a cylindrical section 62*a*, an inward flange section 62*b* formed at a lower portion of the cylindrical section 62*a*, and an outward flange section 62*c* formed at an upper portion of the cylindrical section 62*a*. There are formed plural holes 62*f* in the cylindrical section 62*a*. Thereby, an inner space 62*e* and an outer space 62*d* communicate with each other. The inner space 62*e* is defined between the exterior member 61 and the interior member 62, and the outer space 62*d* is provided between the interior member 62 and the outer cylindrical member 2.

Similarly to the lower wall member 6*a*, the upper wall member 6*b* also includes the exterior member 61 and the interior member 62, both of which are shaped approximately like inverted forms of the exterior and interior members 61, 62 of the lower wall member 6*a*, respectively. Namely, the exterior and interior members 61, 62 of the upper wall member include cylindrical sections 61*a*, 62*a*, outward flange sections 61*b*, 62*c*, and inward flange sections 61*c*, 62*b*, respectively, and are arranged above the lower wall member 6*a* so that the passage plate 3 is pinched between the outward flange sections 62*c*, 62*c* of the interior members 62, 62, thereby forming a reaction chamber 7 between the inward flange sections 61*c*, 61*c* of the exterior members 61, 61. Axial dimensions of the passage plate 3, the exterior members 61, 61, and the interior members 62, 62 are determined so as to form the reaction chamber 7.

There are provided a first and a second sealing rings 63, 63 to seal contact surfaces between the outer cylindrical member 2 and the exterior members 61, 61 included in the lower and upper wall members 6*a*, 6*b*, respectively. The passage plate 3 has a main section 31 and an inner section 32 projecting inwardly from the main section 31 (shown in FIGS. 2 and 3(*a*)). The inner section 32 is formed integrally with the main section 31 having a thinner thickness than a thickness of the reaction chamber 7 in up and down directions thereof. As shown in FIG. 1, the passage plate 3 is arranged so that a tip of the inner section 32 is placed at a middle portion of the reaction chamber 7 in a radial direction of the reaction chamber 7.

The second sleeve 41 is arranged on an inner side of the exterior member 61 included in the upper wall member 6*b* with a slidable contact in its axial direction, i.e., up and down directions of the component. The second sleeve pushes the second O-ring 4 downwardly. Also, the second push ring 42 is provided between the annular cover member 23 and the outward flange section 61*b* of the exterior member 61 included in the upper wall member 6*b* with a slidable contact in the radial direction of the outer cylindrical member 2. The second push ring 42 has a tapered surface 42*a* that is in contact with an upper end of the second sleeve 41, and is disposed in order to be pushed toward a center thereof by the push rods 43. The cylindrical wall section 21 of the outer cylindrical member 2 has an inlet 21*a* and an outlet 21*b*. The inlet 21*a* communicates with the outer space 62*d* at a lower portion of the outer space 62*d*, while the outlet 21*b* is in communication with the outer space 62*d* at an upper portion of the outer space 62*d*, in an axial direction of the piston P. Namely, as shown in FIG. 1, an inlet passage X, which is in communication with the inlet 21*a* and the reaction chamber 7, is defined by lower portions of the outer and inner spaces 62*d*, 62*e*, and the holes 62*f*. On the other hand, an outlet passage Y, which is in communication with the reaction chamber 7 and the outlet hole 21*b*, is defined by upper portions of the outer and inner spaces 62*d*, 62*e*, and the holes 62*f*.

Dimensions of above described elements are preferably determined that a position of a top ring groove 10 of the piston P becomes identical to that of the reaction chamber 7 in the axial direction of the piston P, having the first and second O-rings 4, 4 located nearby upper and lower edges of the top ring groove 10, respectively, when the receiving hole of the container 1 receives the piston P in the inverted state with a bottom surface of the piston P (piston head) abutting a concave portion 51 formed on an upper surface of the bottom member 5. Thereby, upper and lower boundary lines K, K, which define an area to be anodized, are determined.

The outer cylindrical member 2 has a penetration hole 21*c*, which receives a push tube 25, at a portion that faces to an outer cylindrical surface of the passage plate 3. There is provided a sealing ring 26 in the penetration hole 21*c*. The push tube 25 exerts the sealing ring 26 to prevent a leakage of the reaction medium into the penetration hole 21*c*. A conductive rod 33 is inserted into the push tube 25 having an end portion thereof abutted the outer cylindrical surface of the passage plate 3 that acts as an electrode. Namely, the conductive rod 33 is arranged so as to abut the passage plate 3 at a portion not to be exposed in the reaction medium and an outside of passages of the reaction medium. The push tube 25 is fixed in the penetration hole 21*c*, with a pushed state toward the passage plate, by a screw tube 25*a* and a screw 25*b*. That is, the screw tube 25*a* is secured to the outer cylindrical member 2, and the screw 25*b*, in turn, is fixed to the screw tube 25*a*. A drain hole 52 is provided at a center of the concave portion 51 for draining the reaction medium that might leak from the reaction chamber 7 when the piston P is removed from the receiving hole. Also, another electrode 8 is provided so as to abut the piston P when the piston is received in the receiving hole.

As described previously, according to the first embodiment of the present invention, when the first and second push rings 42, 42 are urged inwardly by the push rods 43, 43 having the piston P received in the receiving hole, the annular tapered surfaces 42*a*, 42*a* of the first and second push rings 42, 42 abut the upper end of the first sleeve 41 and the lower end of the second sleeve 41, respectively. Thus, the first and second sleeves 41, 41 move in those axial directions, and compress the first and second O-rings 4, 4, respectively. By virtue of the compression by the axial movement of the sleeves 41, 41, the O-rings 4, 4 shorten their inner diameters in the axial direction of the piston P. Thereby, the O-rings 4, 4 abut the boundary lines K, K providing a sealing function. The reaction chamber 7 that holds the reaction medium is formed among an annular surface of the piston P (a portion being anodized), the first and second O-rings 4, 4 and an inner surface of the receiving hole. The annular cylindrical surface of the piston P includes a surface of the top ring groove 10.

When a pump (not shown) is started, the reaction medium is supplied to the reaction chamber 7 through the inlet 21*a* and the inlet passage X, i.e., the outer space 62*d*, the holes 62*f* and the inner space 62*e*. Then, the reaction medium is directed to the surface of the top ring groove 10 passing through a lower side of the inner section 32 of the passage plate 3. Through an upper side of the inner section 32 of the passage plate 3, the reaction medium leaves the reaction chamber 7, and then, flows to the outlet passage Y, i.e., the inner space 62*e*, the holes 62*f*, the outer space 62*d* and the outlet 21*b*. At this time, direct current is supplied to the passage plate 3 and the electrode 8 in order to carry out an anodizing reaction. Thereby, the anodic treatment on a limited portion of the piston P including the surface of the top ring 10 can be annularly provided.

As detailed above, after the piston P is placed in the receiving hole, the O-rings 4, 4 abut the cylindrical surface of the piston P providing the boundary lines K, K that determine the annular cylindrical surface, by axial movements of the first and second sleeves 41, 41 caused by inward movements of the push rods 43. Thus, the anodic treatment at the middle portion on the cylindrical surface of the piston P is provided without requiring a masking procedure. This brings a reduced working efficiency and a processing capability. Further, according to the first embodiment of the present invention, the area that is exposed to the reaction medium is made narrower by the O-rings 4, 4, so that less electric power is necessary, as compared to the conventional apparatus for anodizing the piston top surface. Thereby, a heat generation is reduced. Also, since volume of the reaction chamber 7 is small and a flow of the reaction medium is formed in the horizontal direction of the passage plate 3, a flow velocity of the reaction medium is obtained with a smooth flow. This provides an improvement in a cooling efficiency of the reaction medium. By this reason, a lower capability of a cooling machine for the reaction medium is required. Also, a volume of the reaction medium necessary for the anodic treatment of the piston is reduced.

A volume of the reaction chamber 7 is dimensioned in accordance with an area of the annular cylindrical surface, so that the reaction chamber circulates in the reaction chamber with high-efficiency. Thus, it becomes possible to downsize the apparatus. Also, because of the area of the annular cylindrical surface that is dimensioned narrowly, the amount of harmful gases, such as hydrocarbon, that might adhere to an anodized surface is reduced. The reaction medium is supplied uniformly and simultaneously to the annular cylindrical surface from its periphery, so that a uniform treatment of the anodization is performed in the circumferential direction of the piston P. Furthermore, the outlet 21*b* is provided at a higher position than that of the outlet passage Y, and thus an air mixed in the reaction medium is efficiently exhausted when the reaction medium leaves the container through the outlet 21*b*. Therefore, an uneven reaction of the anodic treatment may be caused by the air mixed in the reaction medium. The inner section 32 is placed in the reaction chamber 7 in order to divide the reaction chamber 7 in up and down directions thereof. Thereby, in a high efficiency, the reaction medium circulates in the reaction chamber 7 that is reasonably dimensioned in accordance with the area of the annular cylindrical surface, and thus, downsizing of the apparatus is obtained.

One of electrodes exposed to the reaction medium may comprise the passage plate 3 that is arranged in the reaction chamber 7, so that the electrode is located nearby the piston P within a narrow area. By virtue of this arrangement, a reaction efficiency is improved. Moreover, the conductive rod 33 provided for carrying an electricity to the passage plate 3 is disposed outside the reaction chamber 7 so as not to be exposed to the reaction medium, thereby preventing a corrosion of a point of the conductive rod 33 and the passage plate 3 that might be caused by the reaction medium.

As shown in FIG. 3(*b*) the passage plate 3' may be formed so that the inner section 32' is not energized by the electrode (i.e., remains de-energized). The main section 31' is in contact with the conductive rod 33 and is energized during the anodic treatment of the component to function as the required electrode for anodization (i.e., the cathode).

It is possible for sparks to be generated between anodization electrodes located in close proximity (i.e. between the piston and the passage plate). The occurrence of sparks is detrimental to the formation of a high-quality anodization layer at the top ring groove of the piston. As described above, an embodiment of the present invention provides for the separation of the passage plate into conductive and non-conductive sections. This arrangement helps to prevent the formation of sparks. The piston (anode) and the conductive or main section of the passage plate (cathode) are separated by the inner or non-conductive section of the passage plate. The main section 32' is arranged to contact the reaction medium in the inlet passage and not in the reaction chamber. The non-conductive or inner section 32' extends into the reaction chamber adjacent the piston thereby separating the electrodes and inhibiting the generation of sparks around the top ring groove of the piston.

The lower and upper wall members 6*a*, 6*b*, which are separable in up and down directions based on the treating area (the surface of the top ring groove 10), and the bottom member 5 include a portion that forms at least the receiving hole of the container 1. The first and second O-rings 4, 4 are provided on the lower and upper wall members 6*a*, 6*b*. The passage plate 3 that constitutes one of electrode exposed to the reaction medium is disposed between the lower and upper wall members 6*a*, 6*b*, being pinched therebetween. The lower and upper wall members 6*a*, 6*b*, the passage plate 3 and the annular cylindrical surface of the piston P cooperatively define the reaction chamber 7. Also, the inlet passage X that communicates with the reaction chamber 7 is formed on the lower wall member 6*a*, whereas the outlet passage Y is formed on the upper wall member 6*b*. Thus, the container 1 that has the inlet and outlet passages X, Y, both communicating with the reaction chamber 7, is assembled easily by stacking those elements in up and down directions.

Figure 4:
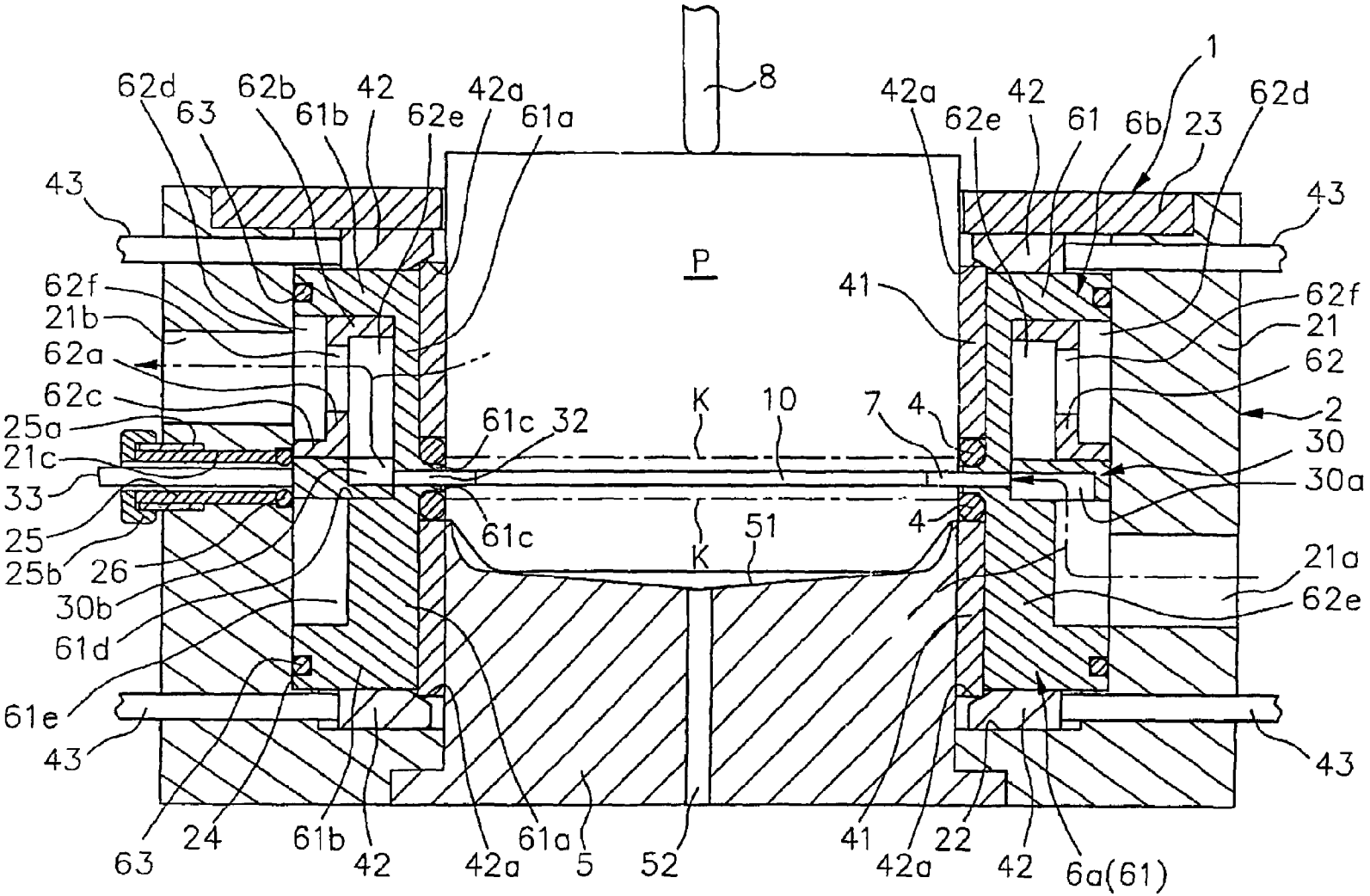
FIG. 4 is a sectional view of an anodizing apparatus according to a second embodiment of the present invention.

Next, an anodizing apparatus according to a second embodiment will be described. In this embodiment, the same or similar references used to denote elements in the anodizing apparatus of the first embodiments will be applied to the corresponding elements used in the second embodiment, and only the significant differences from the first embodiment will be described. FIG. 4 shows a sectional view of the second embodiment of the present invention.

The anodizing apparatus of the second embodiment is similar to the first embodiment shown in FIGS. 1-3, except that it provides an alternative structure for the passage plate 30 and the lower wall member 6*a*. Namely, the lower wall member 6*a* comprises only the exterior member 61. Also, except at an upper end portion thereof, the cylindrical section 61*a* is provided with a heavier wall thickness than that of the first embodiment so that a stepped portion 61*d* is formed thereon. According to the second embodiment of the present invention, only the outer space 61*e* is defined in the lower wall member 6*a*, whereas the lower wall member 6*a* of the first embodiment defines the outer and inner spaces 62*d*, 62*e*.

Figure 5:
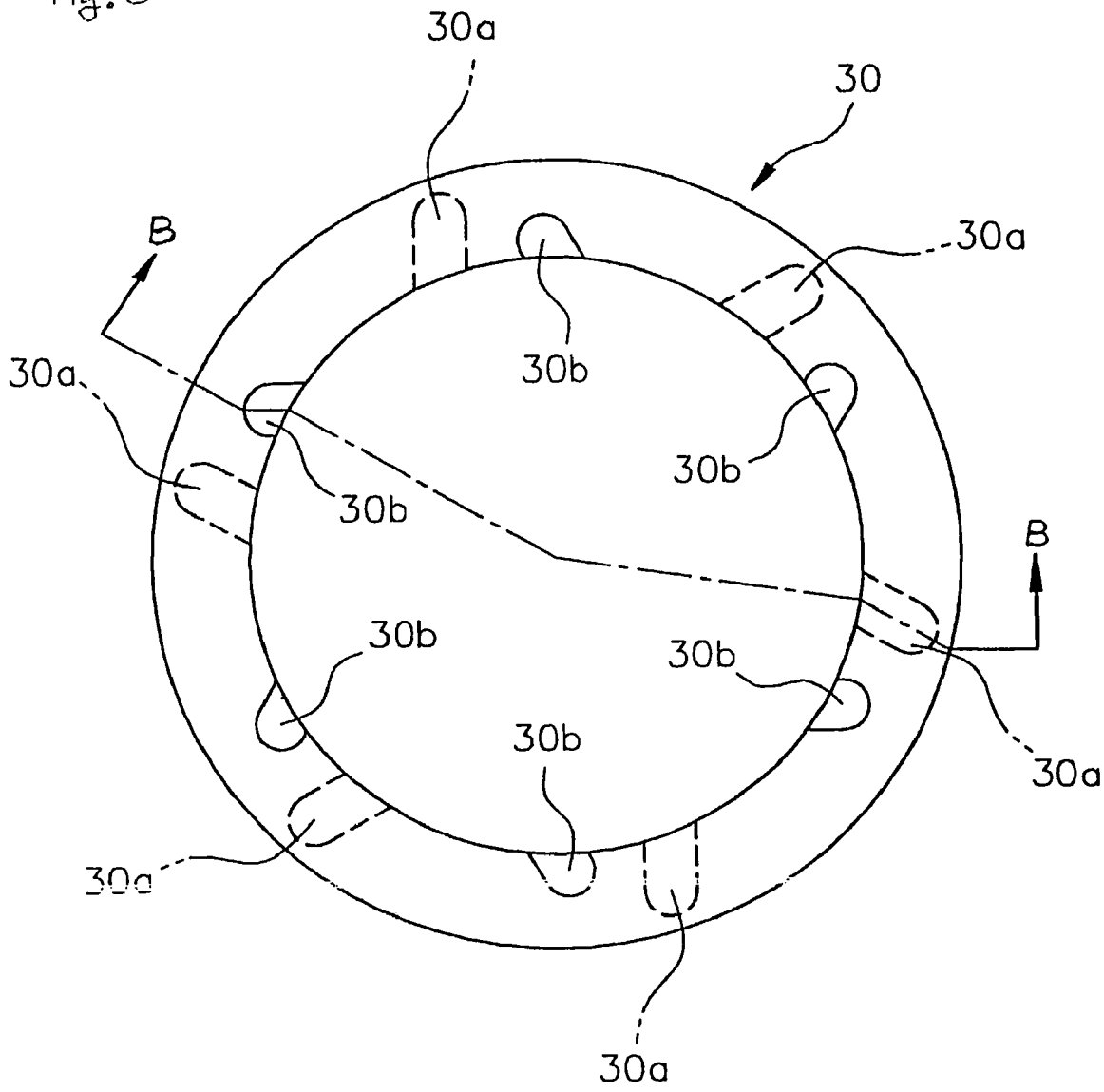
FIG. 5 is a front view of a passage plate according to the second embodiment of the present invention.
Figure 6:
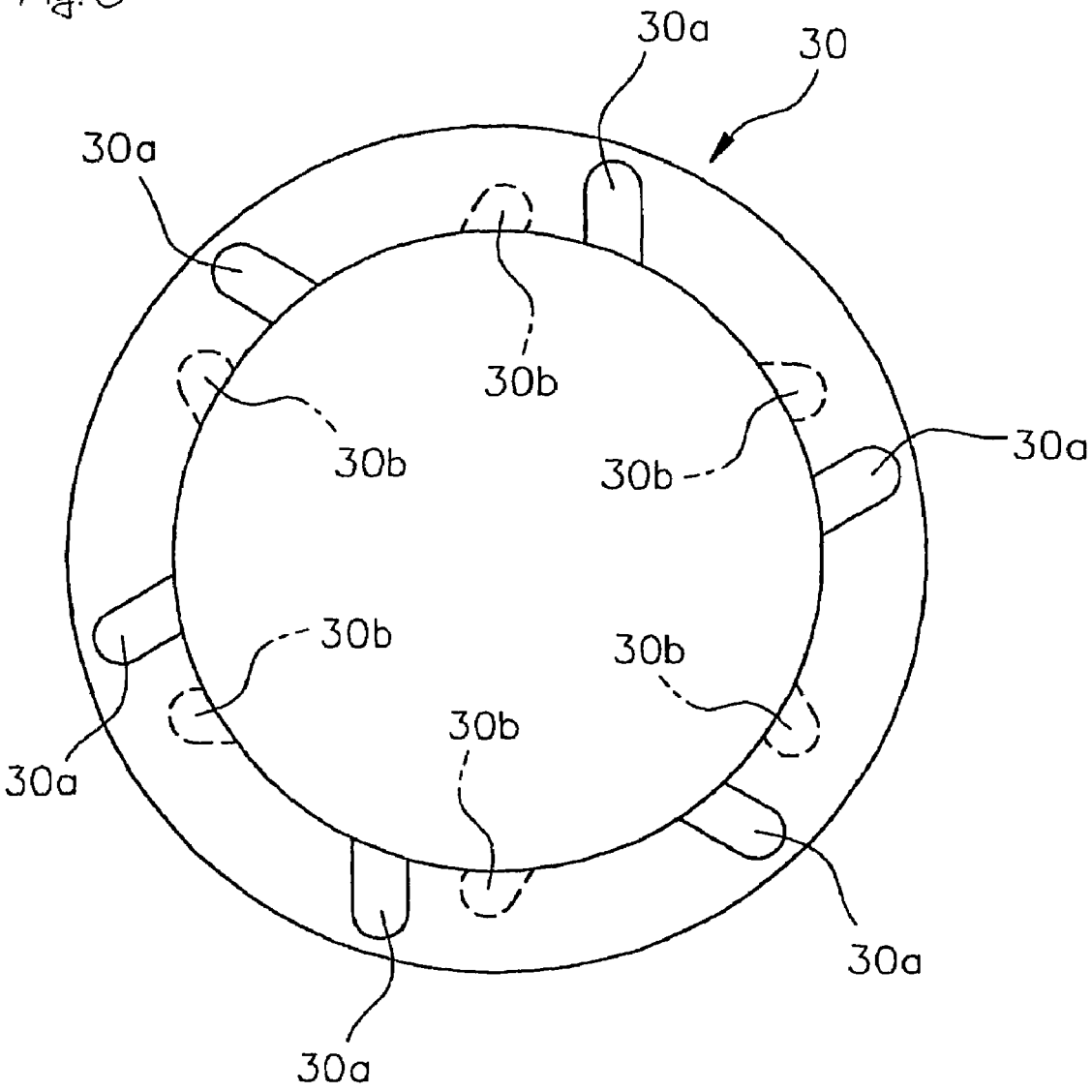
FIG. 6 is a bottom view of the passage plate according to the second embodiment of the present invention.
Figure 7:
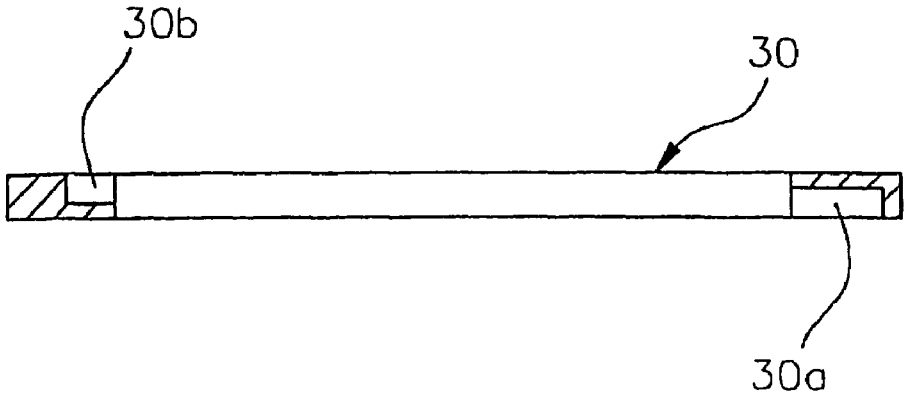
FIG. 7 is a sectional view of the passage plate taken on line B-B of FIG. 5.

As shown in FIGS. 5-7, the passage plate 30 includes six supply grooves 30*a* and six drain grooves 30*b*. Each of the supply grooves 30*a* constitutes a part of the inlet passage X, and is preferably formed on a lower face of the passage plate 30. Similarly, each of the drain grooves 30*b* constitutes a part of the outlet passage Y, and is formed on an upper face of the passage plate 30. The supply grooves 30*a* are provided in the same interval. The drain grooves 30*b* are also arranged in the same interval. The supply grooves 30*a* and the drain grooves 30*b* are formed alternately together in the circumferential direction of the passage plate 30 so that each supply groove 30*a* does not overlap with any of drain grooves 30*b* in an axial direction of the passage plate 30.

As shown in FIGS. 5 and 6, the supply grooves 30*a* and the drain grooves 30*b* have angles by which the reaction medium is directed or leaves the annular cylindrical surface of the piston P having a predetermined angle. The angles of the supply and drain grooves 30*a*, 30*b* are determined so that the angle of a supply groove relative to the tangent to the piston P at the supply groove is opposite to the angle of a drain groove relative to the tangent to the piston P at the drain groove. The angles of the drain and supply grooves are symmetrical about a line perpendicular to the surface to be anodized. The direction of each supply groove 30*a* is angled toward an opposite direction to that of each drain passage 30*b*. The passage plate 30 is disposed between the outward flange section 62*c* of the interior member 62 and the stepped portion 61*d* of the exterior member 61, being pinched therebetween.

When the pump starts to operate, the reaction medium is introduced, through the supply grooves 30*a* and the supply passage X (namely, the outer space 61*e*), into the reaction chamber 7 in which the reaction medium is directed toward the piston P at the predetermined angle. Then, the reaction medium leaves the reaction chamber 7 having at the predetermined angle through the drain grooves 30*b*, and flows to the outlet 21*b* through the drain passage Y (namely, the outer space 62*e* of the upper wall member 6*b*, the holes 62*f*, and the outer space 62*d*).

Thus, according to the second embodiment of the present invention, an increased velocity and a smooth flow of the reaction chamber is obtained by virtue of following features, which requires a lesser performance of a cooling machine for cooling the reaction medium, as compared to the conventional art. First, the axial directions of the supply grooves 30*a* and drain grooves 30*b* are in a horizontal direction of the passage plate 30, and are substantially the same level as that of the top ring groove 10 in the axial direction of the piston P. Second, plural supply grooves 30*a* and drain grooves 30*b* (in this embodiment, six supply grooves and drain grooves) are arranged on both sides of the passage plate 30 having those arranged alternately with each other. Third, directions of the supply grooves 30*a* are at a pre-determined angle to the surface of the piston P, while directions of the drain grooves 30*b* are at an angle opposite to that of the supply grooves 30*a*.

Figure 8:
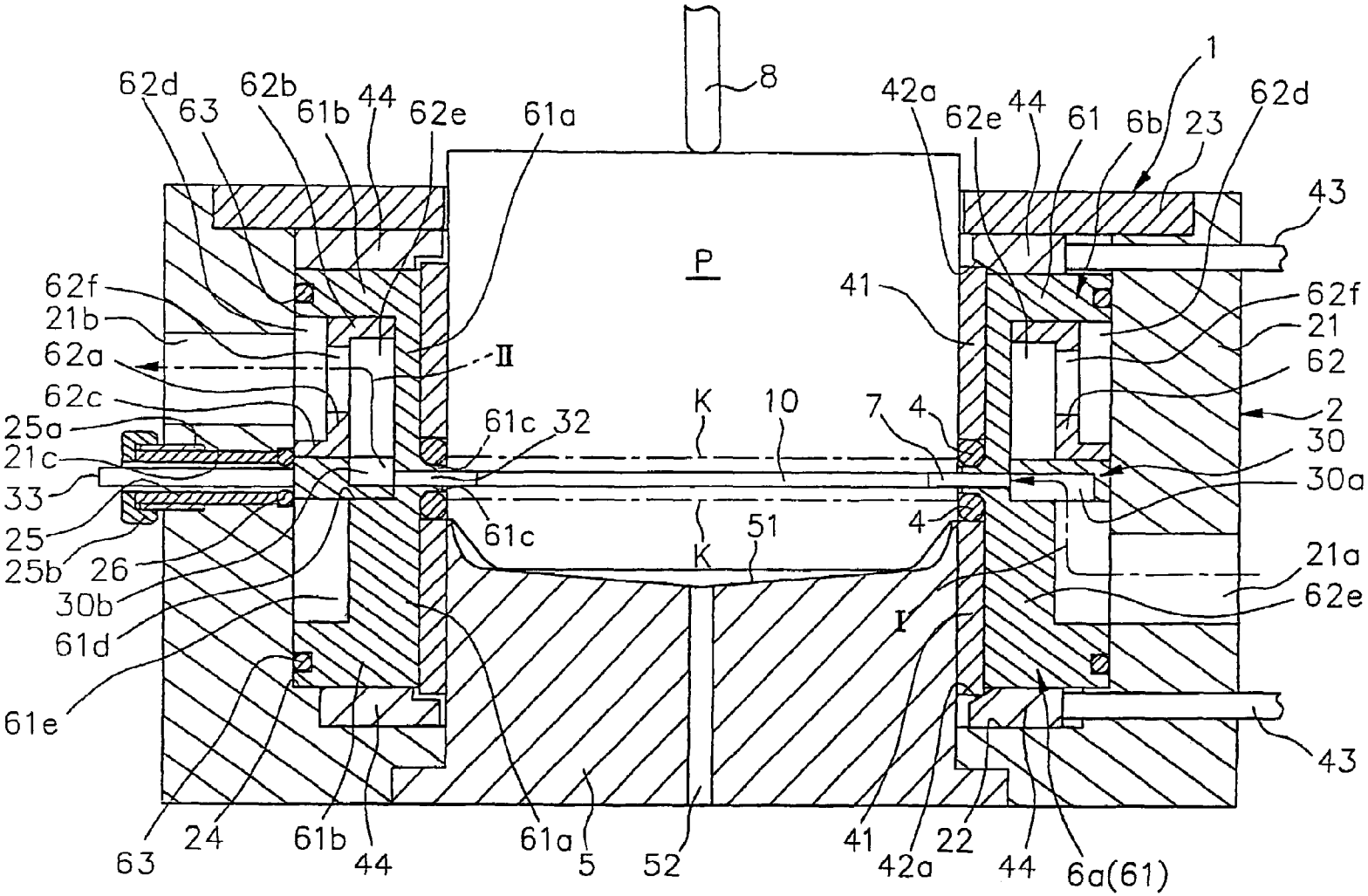
FIG. 8 is a sectional view of an anodizing apparatus according to a third embodiment of the present invention.

Next, an anodizing apparatus according to a third embodiment of the present invention now will be described. FIG. 8 is a cross sectional view of the third embodiment. As will be appreciated, this embodiment is similar to the second embodiment, except that a rigid member 44 is used in place of one part of the first and second push rings 42, 42, and that the push rods 43, 43 are provided on only one side of the container 1. Therefore, the number of parts and a cost of the apparatus are both reduced.

Figure 9:
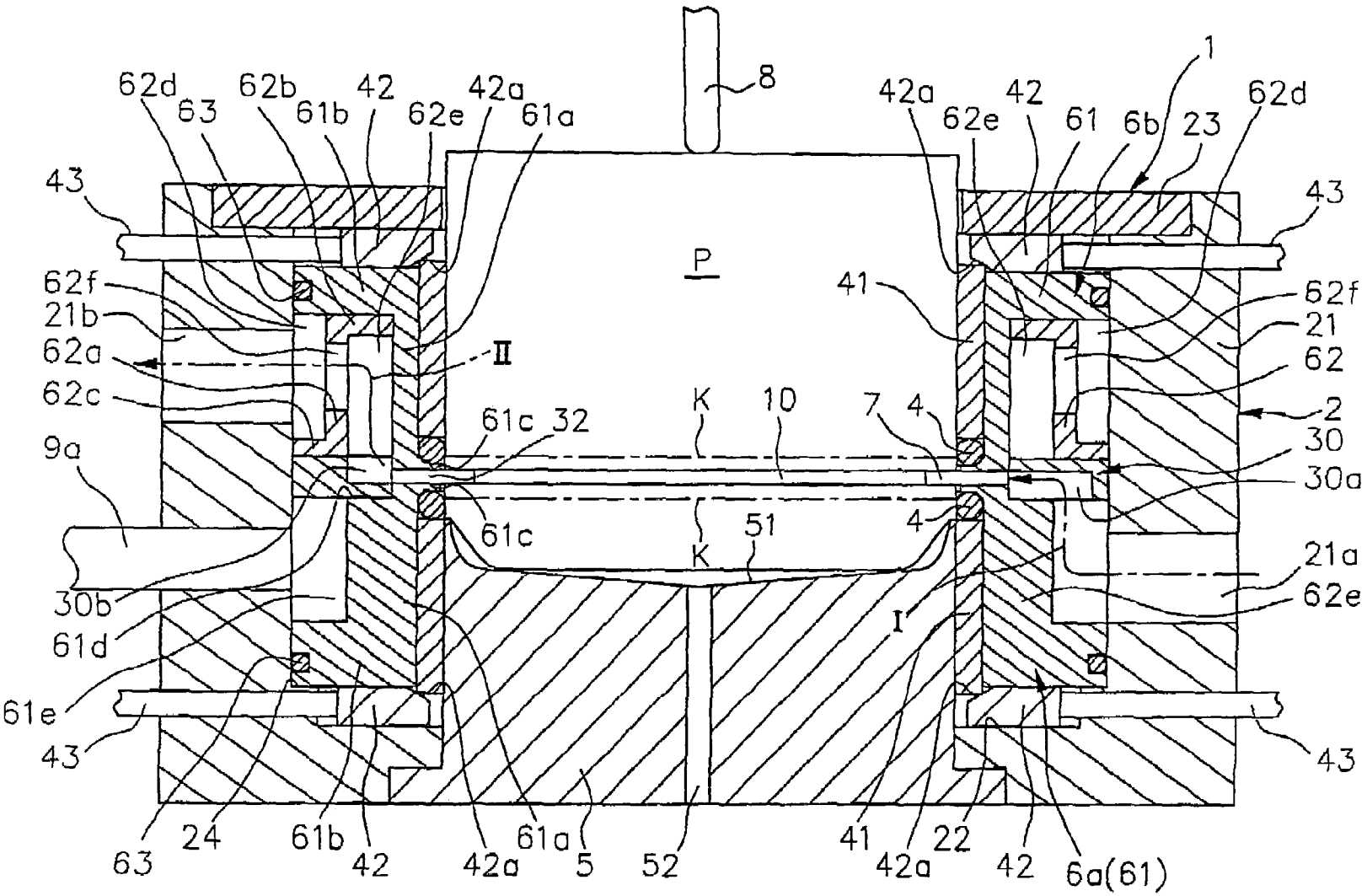
FIG. 9 is a sectional view of an anodizing apparatus according to a fourth embodiment of the present invention.

FIG. 9 is a cross sectional view of a fourth embodiment of the present invention. As will be appreciated, the third embodiment is substantially the same as the second embodiment. The main difference from the second embodiment is that one of the electrodes that is exposed to the reaction medium comprises an electrode rod 9*a* whereas the electrode of the second embodiment comprises the passage plate 30. Namely, the electrode rod 9*a* passes through the outer cylindrical member 2 in the radial direction of the container 1, so that an end portion of the electrode rod 9*a* is exposed to the reaction medium.

Figure 10:
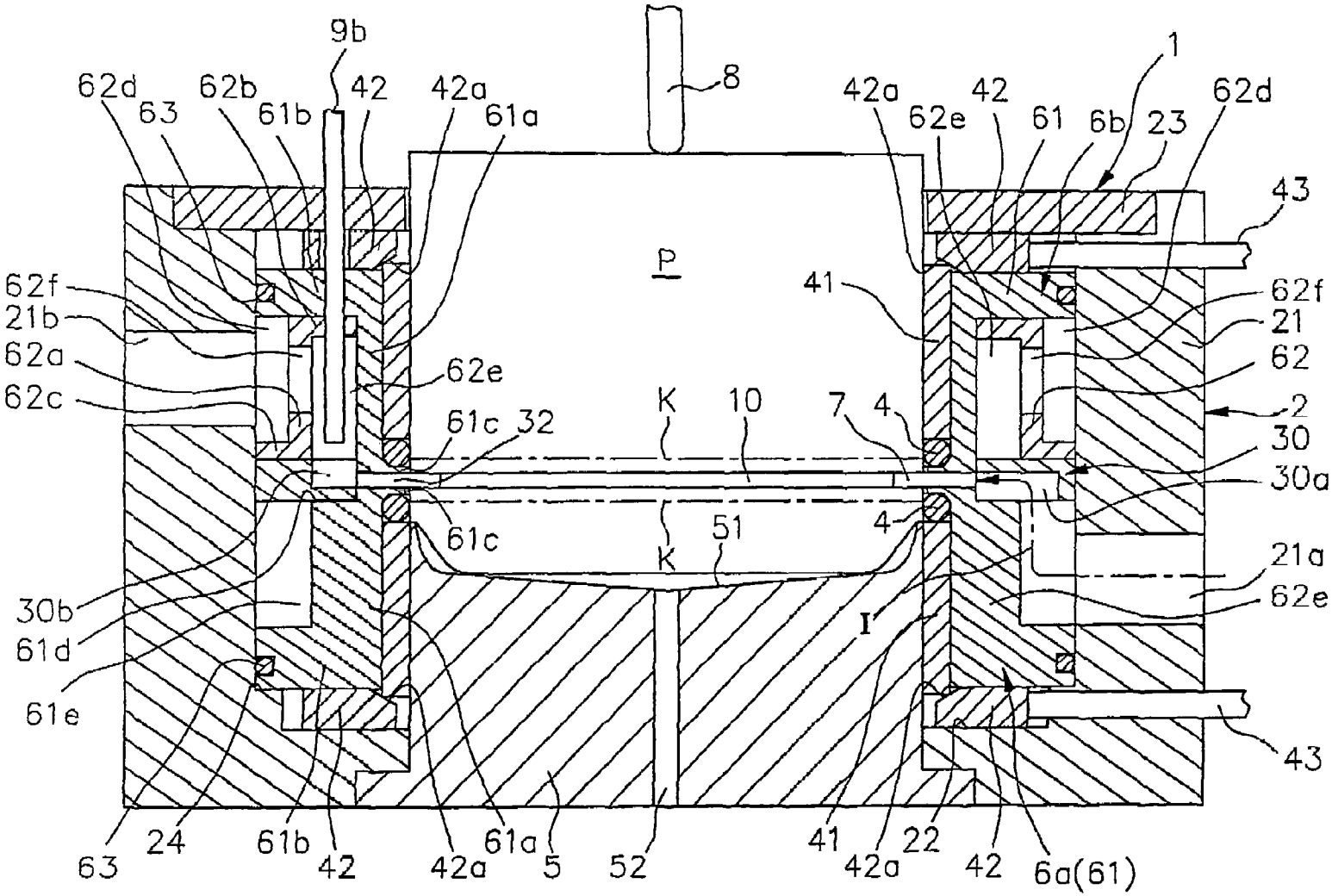
FIG. 10 is a sectional view of an anodizing apparatus according to a fifth embodiment of the present invention.

FIG. 10 is a cross sectional view of a fifth embodiment of the present invention. Similarly to the fourth embodiment, one of electrodes that is exposed to the reaction medium comprises an electrode rod 9*b*. The difference in this embodiment from the fourth embodiment is that the electrode rod 9*b* penetrates annular cover member 23, the rigid member 44, and the upper wall member 6*b*, having its bottom end exposed to the reaction medium. Both the fourth and fifth embodiments provide, in addition to the features described in the second embodiment of the present invention, a simplified structure of the apparatus.

Figure 11:
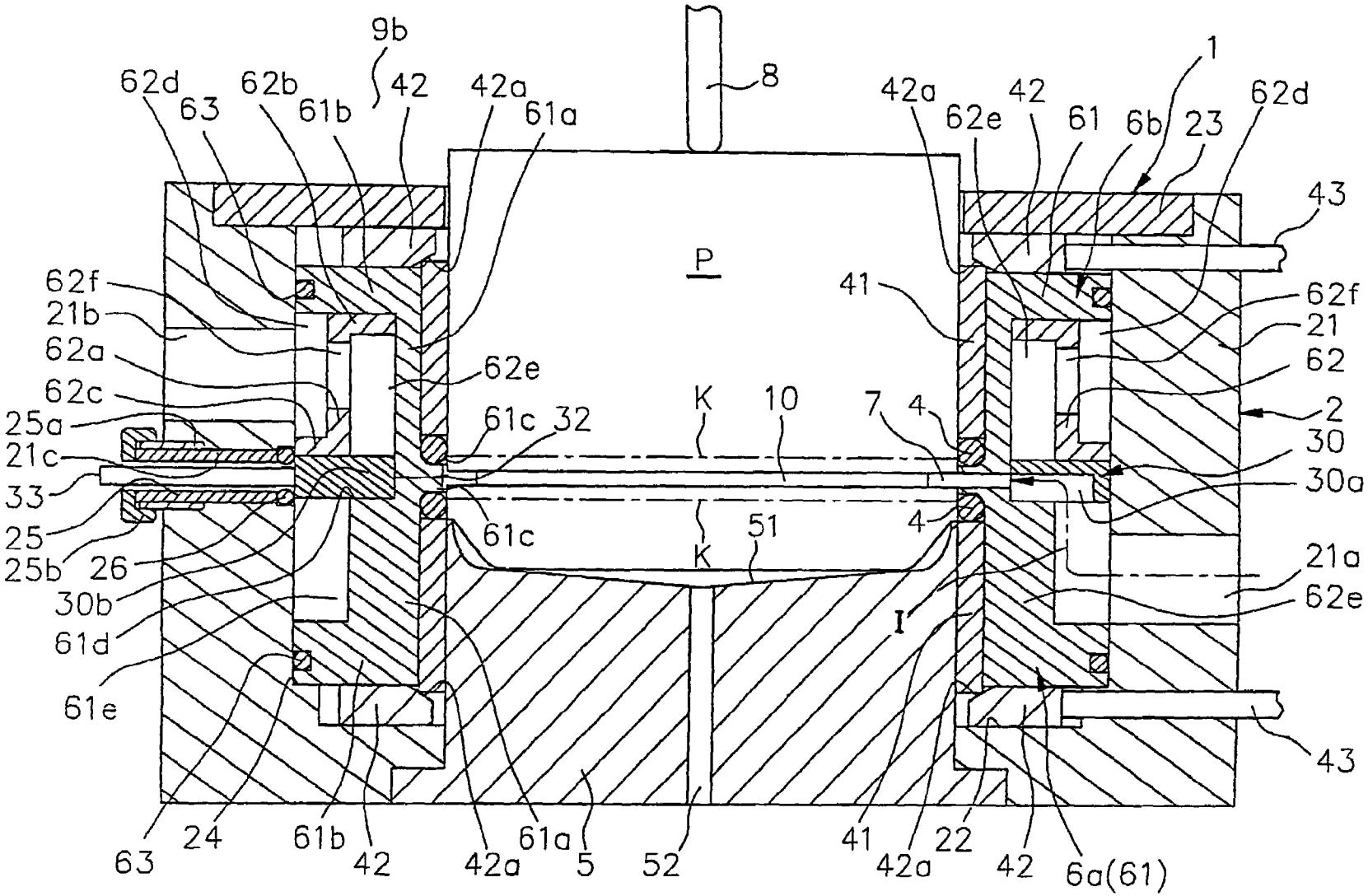
FIG. 11 is a sectional view of an anodizing apparatus according to a sixth embodiment of the present invention.

FIG. 11 is a cross sectional view of a sixth embodiment of the present invention. As shown in FIG. 11, this embodiment is substantially the same as the second embodiment, except that a part of the exterior member 61 included in the upper wall member 6*b* and the lower wall member 6*a* abut with each other at a place other than which the supply and drain grooves 30*a*, 30*b* are formed. Since the lower and upper wall members 6*a*, 6*b* abut with each other, the width of the reaction chamber 7 in the axial direction of the piston P is secured. Also, the annular cylindrical surface may be freely selected in the radial direction of the piston P by selecting a radial position of the abutting portion of the lower and upper wall members 6*a*, 6*b*.

Figure 12:
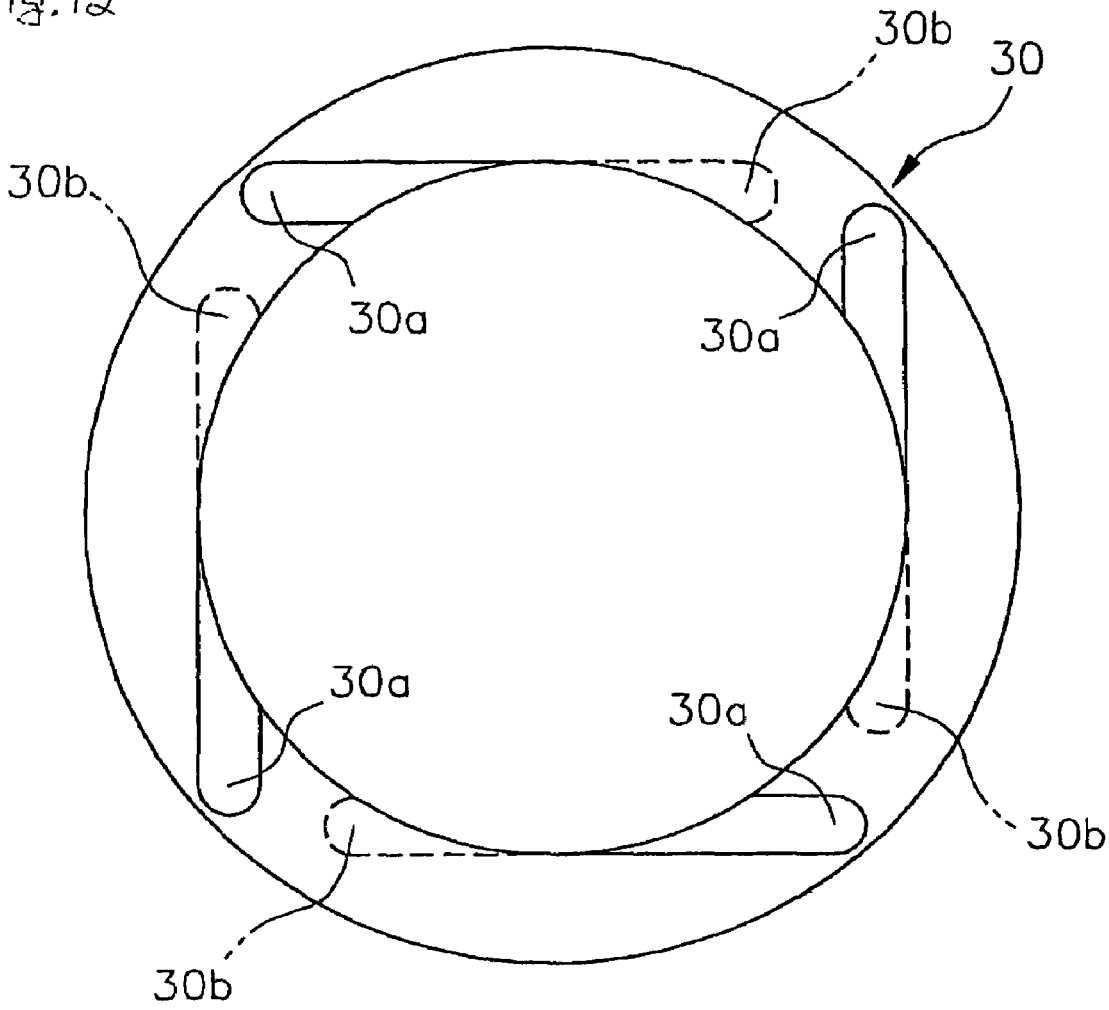
FIG. 12 is a sectional view of an anodizing apparatus according to a seventh embodiment of the present invention.

FIG. 12 shows a bottom view of the passage plate 30 of a seventh embodiment of the present invention. As shown in FIG. 12, the supply and drain grooves 30*a*, 30*b* are formed so that those axial lines are parallel with the tangents to the piston P. Thus, the reaction medium is introduced into the reaction chamber 7 having at angle of approximately 0 degrees. In this case, a capability of the anodic treatment is improved by virtue of the smooth flow of the reaction medium obtained by this embodiment.

Figure 13:
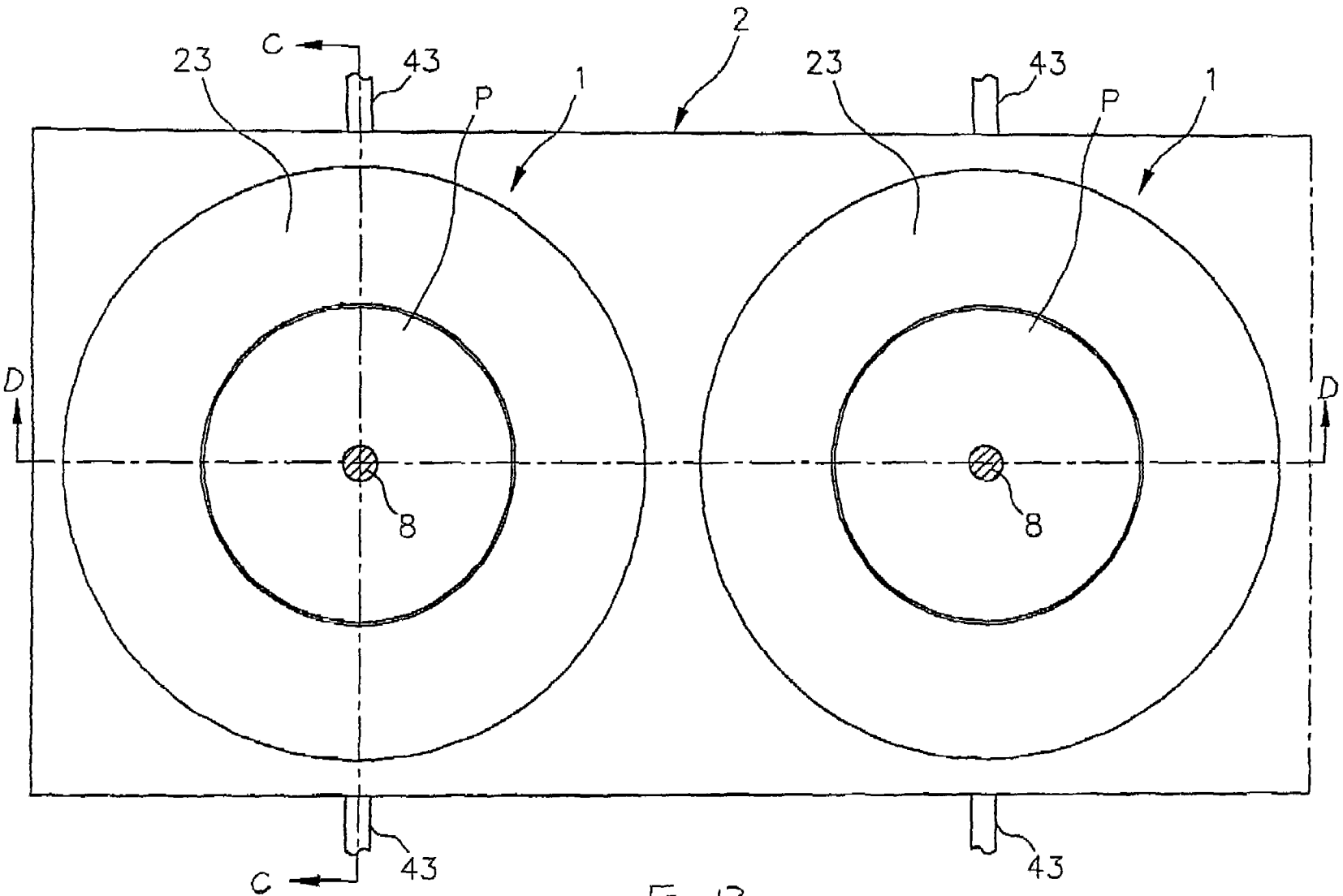
FIG. 13 is a sectional view of an anodizing apparatus according to an eighth embodiment of the present invention.
Figure 14:
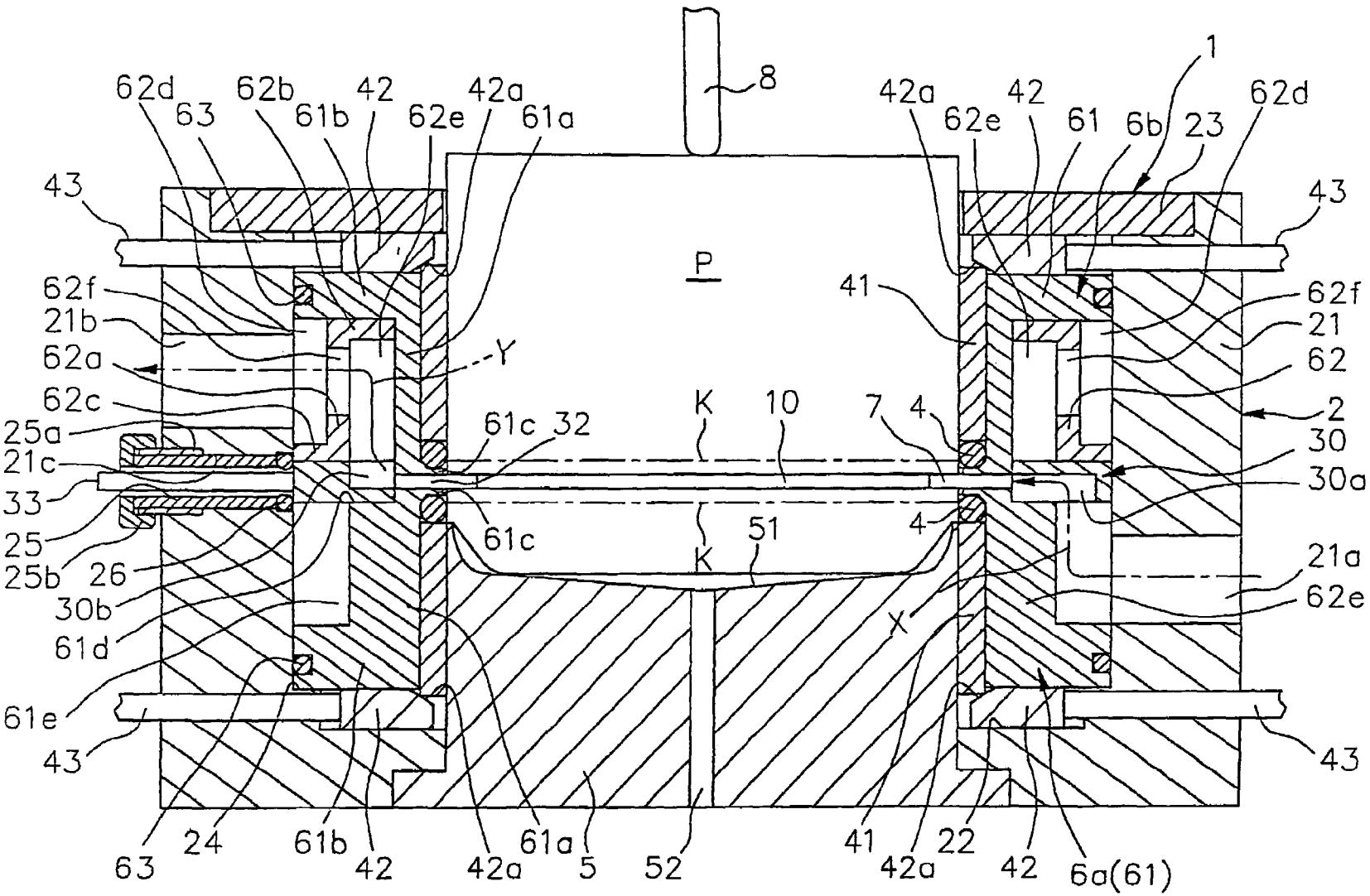
FIG. 14 is a sectional view taken on line C-C of FIG. 13.
Figure 15:
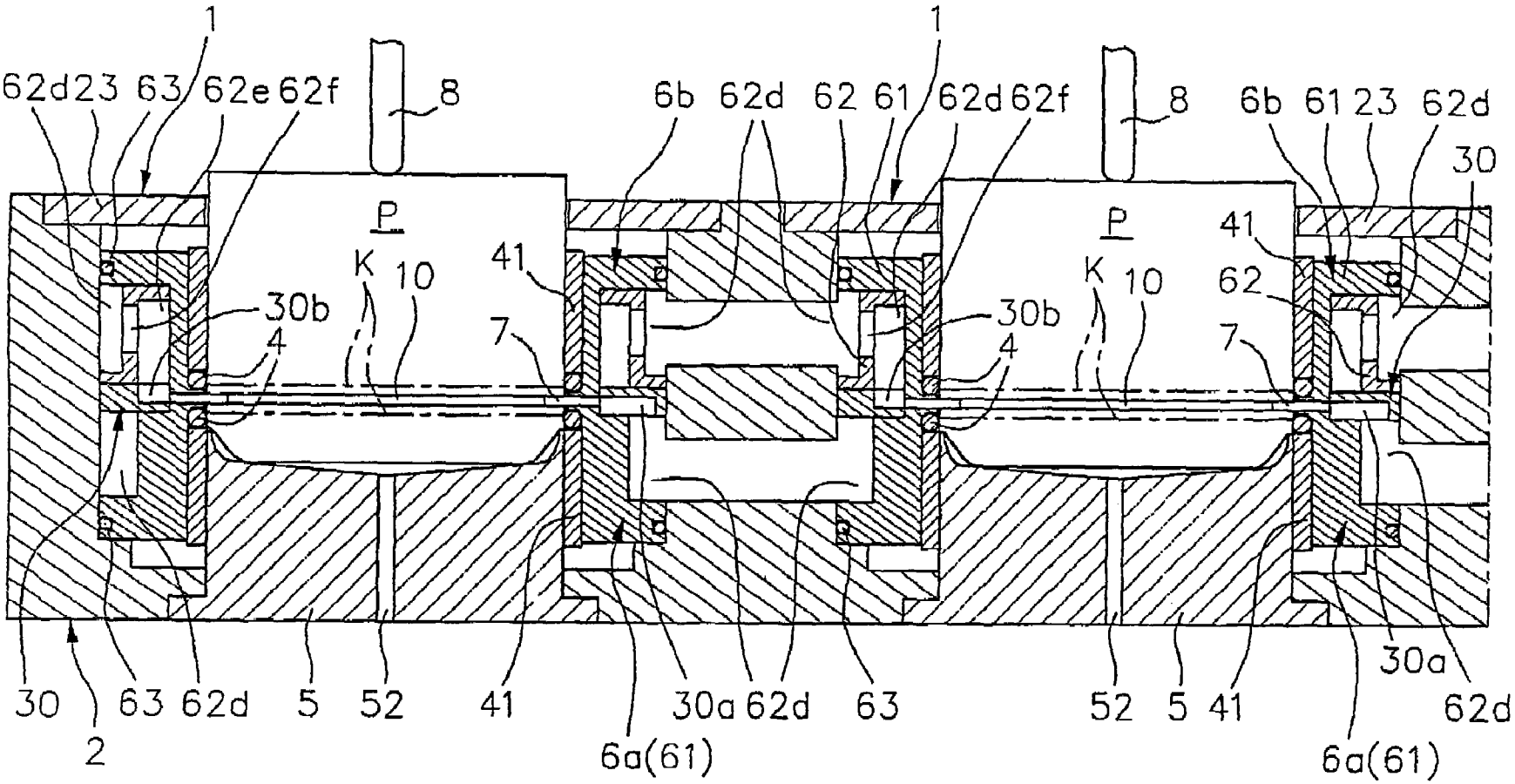
FIG. 15 is a sectional view taken on line D-D of FIG. 13.

FIGS. 13-15 show a eighth embodiment of the present invention. As shown in FIG. 13, plural apparatuses that are substantially the same as the second embodiment are coupled together. That is, as shown in FIG. 15, the outer spaces 61*d*, 61*a* of adjoining apparatuses are connected with each other, while the upper outer spaces 62*d*, 62*d* are coupled together at a connecting portion between adjoining apparatuses. Thereby, plural apparatuses are coupled together in a compact shape.

Figure 16:
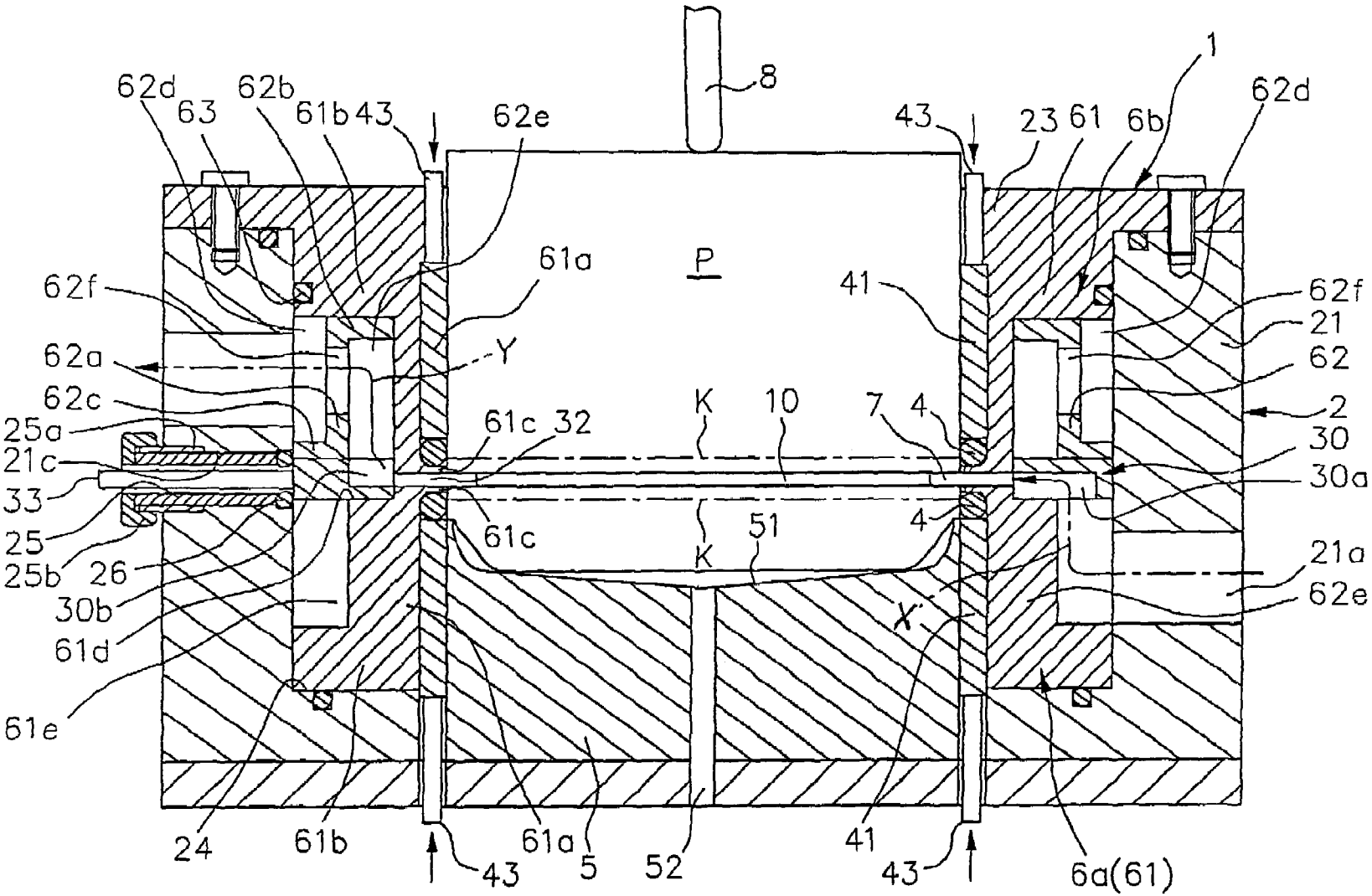
FIG. 16 is a sectional view of an anodizing apparatus according to a ninth embodiment of the present invention.

In FIG. 16, there is shown a ninth embodiment. As will be appreciated, the ninth embodiment is substantially the same as the second embodiment of the present invention, except that another way is employed for the push mechanism for compressing the first and second O-rings 4, 4. Namely, the apparatus in this embodiment does not include the first and second push rings 42, 42. Instead of this, the push rods 43, 43 directly press the first and second sleeves 41, 41 in the axial directions of the first and second sleeves 41, 41, respectively. Furthermore, the exterior member 61 included in the upper wall member 6*b* is formed integrally with the annular cover member 23. Therefore, in addition to the feature obtained by the second embodiment of the present invention, simplicity in the structure of the apparatus is obtained. Moreover, where the passage plate 30, the interior member 62, the exterior member 61, and the annular cover member 23 are assembled together as an unified unit, an easy attachment and detachment of the unit is obtained with a reduced time in changing the unit. The first and second sleeves 41, 41 may be assembled together with the unified unit.

Figure 17:
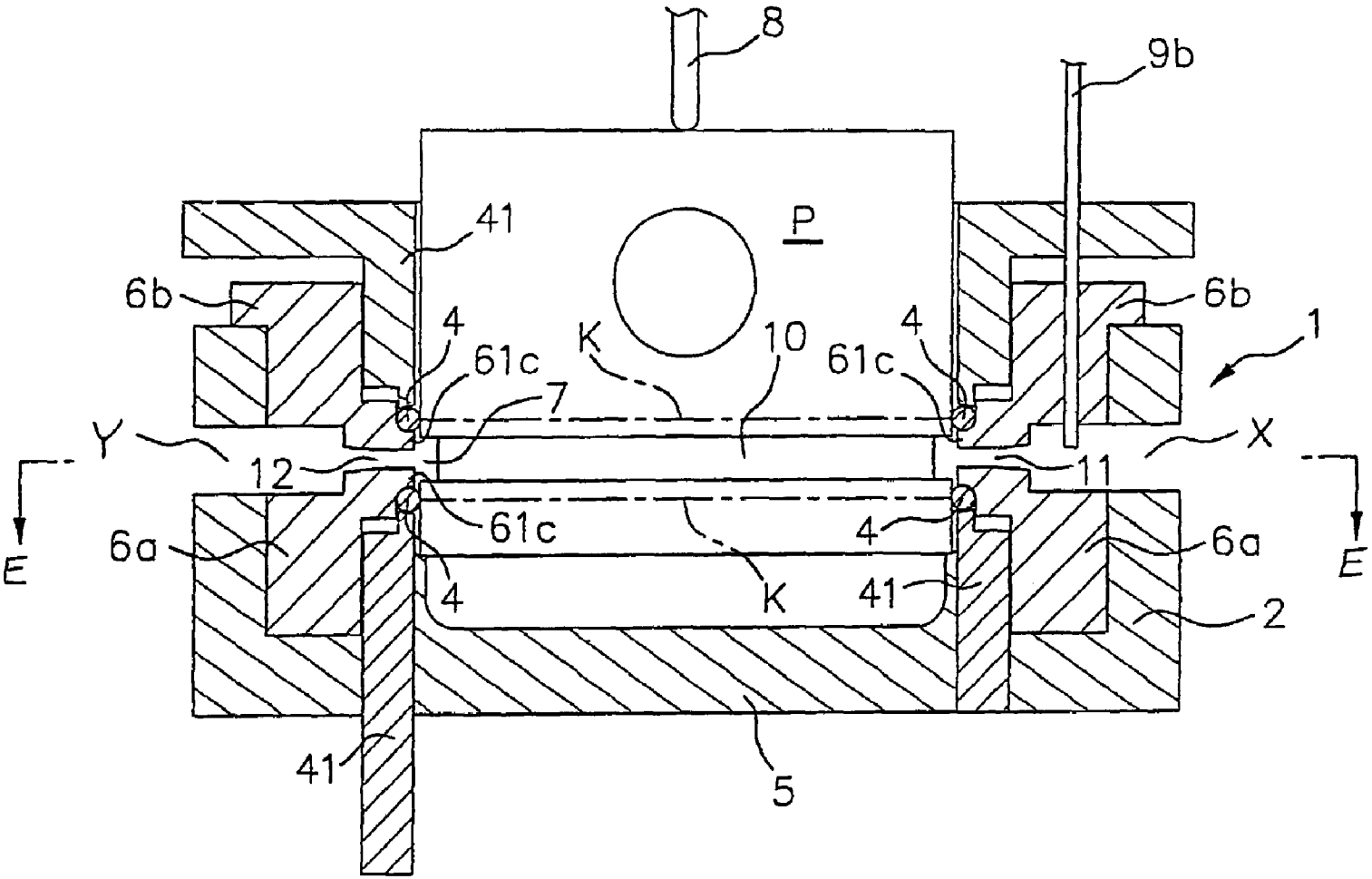
FIG. 17 is a sectional view of an anodizing apparatus according to a tenth embodiment of the present invention.
Figure 18:
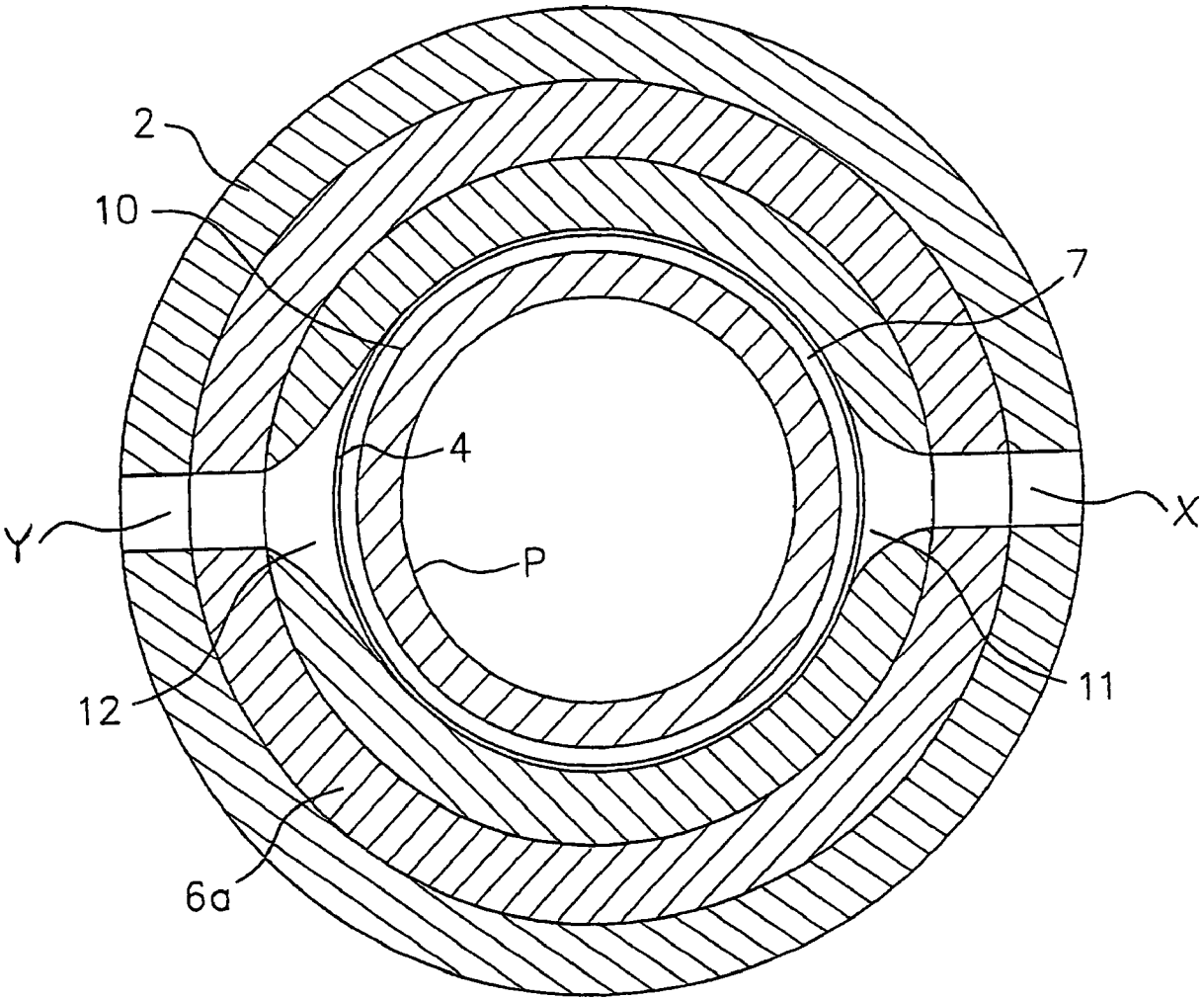
FIG. 18 is a sectional view taken on line E-E of FIG. 10.
Figure 19:
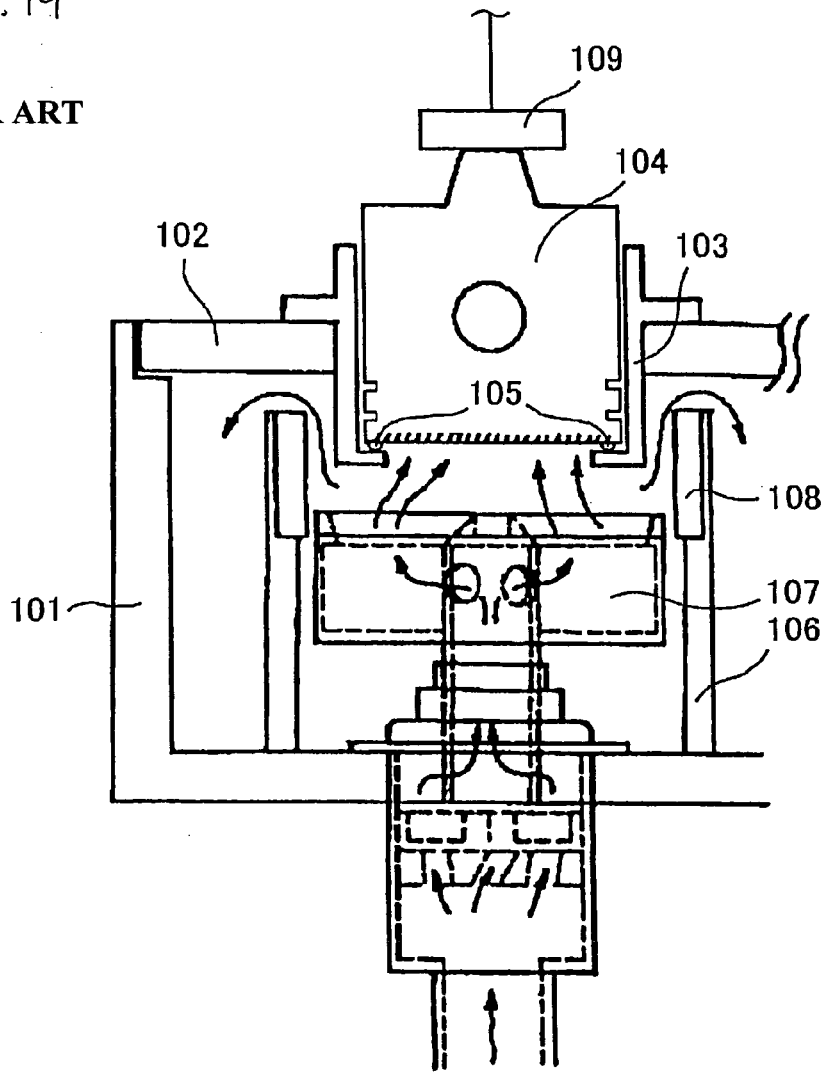
Fig. 19 PRIOR ART
FIG. 19 is a sectional view of an anodizing apparatus according to a conventional art.

FIGS. 17 and 18 show a tenth embodiment of the present invention. As shown in both Figures, as a modified example of the fifth embodiment of the present invention the electrode rod 9*b* of which is arranged separately with the passage plate 30, this embodiment does not include the passage plate 30. Namely, according to the tenth embodiment of the present invention, the container 1 is provided with the supply passage X and the drain passage Y. The supply and drain passages X, Y are placed at opposing positions with respect to each other in the radial direction of the container 1. As shown in FIG. 17, the supply and drain passages X, Y have narrow portions 11, 12, both working as orifices, respectively. The height of both portions 11, 12 in the axial direction of the piston P is smaller than the height of the supply and drain passages X, Y, respectively. As shown in FIG. 18, the circumferential widths are dimensioned so that the width increases toward the reaction chamber 7. This arrangement prevents an increase in temperature of the reaction medium caused by concentrations of the reaction medium that occur at places where the supply and drain passages X, Y have opening portions to the reaction chamber 7.

The increase in the temperature of the reaction medium is more marked on a drain passage side than a supply passage side. Thus, the narrow portions 11, 12 are dimensioned that a width of the narrow portion 12 is wider than that of the narrow portion 11. Although not required, it is preferable that the ratio of the circumferential width at the opening portion of the narrow portion 11 to that of the narrow portion 12 is determined from the range of between 1:1.5 through 1:3. In brief, the ratio may be determined so that the reaction medium in the reaction chamber 7 introduced through the supply passage X smoothly leaves the reaction chamber 7 without being stuck.

As described above, the flow of the reaction medium in the supply passage X is narrowed in a vertical direction of the supply passage X while broadened in the circumferential direction. This provides the smooth flow of the reaction medium in the reaction chamber 7 by which uniformity in contact of the reaction medium with the annular cylindrical surface is efficiently obtained. Thus, according to the tenth embodiment of the present invention, simplicity in the structure of the apparatus is obtained by an omission of the passage plate 30 and a structure of the supply and drain passages X, Y.

While the present invention is described on the basis of certain preferred embodiments, it is not limited thereto, but is defined by the appended claims as interpreted in accordance with applicable law. For example, according to the previously described preferred embodiments of the present invention, although the piston is used as an object for anodization, all metal products that have a middle portion to be anodized on an outer surface in those axial directions may be anodized.

This application relates to and incorporates herein by reference Japanese Patent application No. 2001-238157 filed on Aug. 6, 2001, and No. 2001-6525 filed on Jan. 15, 2001 from which priority is claimed.

What is claimed is:

1. An apparatus for anodizing a component comprising:

a container having a receiving hole for receiving the component into the container;

first and second seal members for sealing an annular cylindrical surface at a middle portion of the component such that a reaction chamber is formed between the container, the first and second seal members, and the annular surface of the component;

a supply passage in the container for introducing a reaction medium into the reaction chamber; and a drain passage for draining the reaction medium from the reaction chamber, wherein the container includes a passage plate having an opening for the component to extend through, wherein the passage plate includes a supply groove and a drain groove opening into the reaction chamber.

2. The apparatus of claim 1, wherein the passage plate is positioned about midway between the first and second seals.

3. The apparatus of claim 1, wherein the passage plate is energized by a second electrode.

4. The apparatus of claim 3, wherein a portion of the passage plate adjacent to the reaction chamber remains de-energized.

5. The apparatus of claim 4, wherein the supply groove and the drain groove extend in a direction generally perpendicular to the surface being anodized.

6. The apparatus of claim 1, wherein the supply groove and the drain groove are formed on opposite sides of the passage plate.

7. The apparatus of claim 1, wherein the supply groove and the drain groove comprise plural supply grooves and plural drain grooves, the supply grooves and the drain grooves being arranged alternately to each other around the opening in the passage plate.

8. The apparatus of claim 7, wherein each supply groove extends toward the component at a different angle from each drain groove.

9. The apparatus of claim 1, further comprising an electrode rod abutting the passage plate outside the reaction chamber for energizing the passage plate.

10. The apparatus of claim 9, wherein the first and second sealing members are placed on flange portions formed in the container, and further comprising:

a push mechanism for compressing the first and second seal members so as to seal the outer surface of the component, the push mechanism including a movable sleeve disposed between the component and the container, and a push rod disposed in the container for pushing the sleeve.

11. The apparatus of claim 10, wherein the container includes first and second members separated at the annular surface being anodized, the first and second members being provided with the flange portions for holding thereon the first and second seal members wherein the passage plate is located between the first and second members and the supply passage and the drain passage are each formed in the first member and the second member, respectively, and wherein the reaction chamber is formed between the first member, the second member, and the annular surface.

12. An apparatus for anodizing a component comprising:

a container having a receiving hole for receiving the component into the container, and first and second seal members for sealing an annular cylindrical surface at a middle portion of the component such that a reaction chamber is formed between the container, the first and second seal members, and the annular surface of the component, wherein the first and second seal members are placed on flange portions formed in the container, and further comprising: a push mechanism for compressing the first and second seal members so as to seal the outer surface of the component, the push mechanism including a movable sleeve disposed between the component and the container, and a push rod disposed in the container for pushing the sleeve.

13. An apparatus for anodizing a component comprising:

a container having a receiving hole for receiving the component into the container;

first and second seal members for sealing an annular surface of the component such that a reaction chamber is formed between the container and the annular surface of the component, wherein the container includes a passage plate having an opening for the component to extend through, wherein the passage plate includes a supply groove and a drain groove opening into the reaction chamber.

14. The apparatus of claim 13, further comprising a drain passage for draining reaction medium from the reaction chamber.

* * * * *